United States Patent [19]

Jarvis

[11] 4,399,583

[45] Aug. 23, 1983

[54] HAND FLOAT

[75] Inventor: Jack D. Jarvis, Memphis, Tenn.

[73] Assignee: Aluma-Form, Inc., Memphis, Tenn.

[21] Appl. No.: 316,062

[22] Filed: Oct. 26, 1981

Related U.S. Application Data

[63] Continuation-in-part of Ser. No. 174,569, Aug. 4, 1980.

[51] Int. Cl.[3] ..... B05C 17/10; E01C 19/12

[52] U.S. Cl. ..... 15/235.8; 15/144 R

[58] Field of Search ..... 15/235.4, 235.5, 235.6, 15/235.7, 235.8, 144 R; 404/97

[56] References Cited

U.S. PATENT DOCUMENTS

| | | | |
|---|---|---|---|
| 316,464 | 4/1885 | Huther | 15/235.8 |
| 963,717 | 7/1910 | Linville | 15/235.8 X |
| 1,726,119 | 8/1929 | Paquette | 15/235.8 |
| 2,278,803 | 4/1942 | Stabbert | 15/235.4 |
| 3,166,776 | 1/1965 | Selck | 15/235.6 |
| 3,346,905 | 10/1967 | Scarpelli | 15/235.6 |

*Primary Examiner*—Edward L. Roberts
*Attorney, Agent, or Firm*—Paul M. Denk

[57] ABSTRACT

In a hand float of the type used by a concrete finisher, a plate includes a pair of integral guides extending upwardly therefrom, the upper edges of the guides being inturned, for accommodating fastening means from a handle, so that the handle may be rigidly fixed in place, when adjusted, or loosened for repositioning and before tightening for the convenience of its user.

2 Claims, 9 Drawing Figures

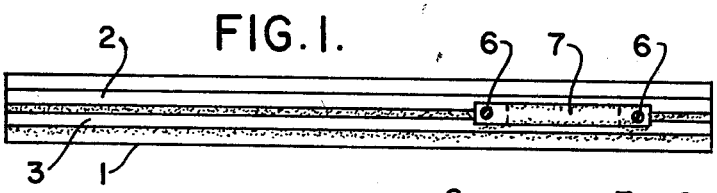
FIG. 1.
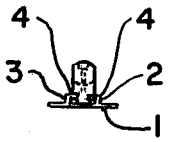
FIG. 2.
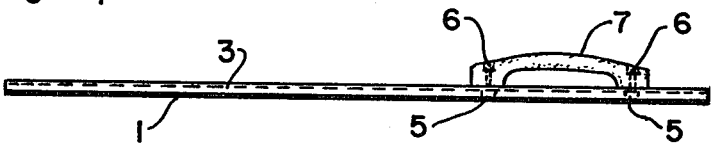
FIG. 3.
FIG. 4.
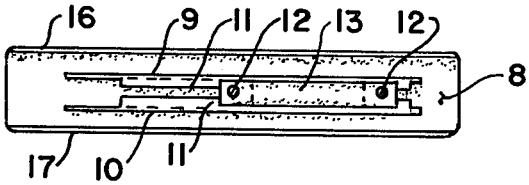
FIG. 5.
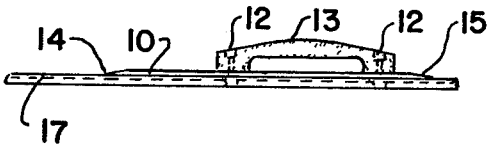
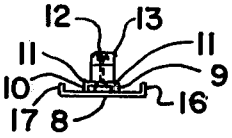
FIG. 6.
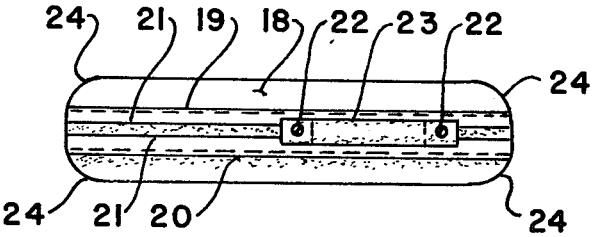
FIG. 7.
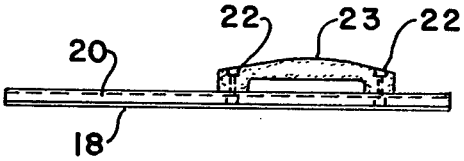
FIG. 8.
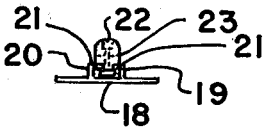
FIG. 9.

HAND FLOAT

CROSS REFERENCE TO RELATED APPLICATION

The subject matter of this application is related to and comprises a continuation-in-part of the application of the same inventor herein, having Ser. No. 174,569, filed on Aug. 4, 1980, and owned by a common assignee.

BACKGROUND OF THE INVENTION

A great many and variety of hand floats are available in the art, and primarily include a plate means having a handle rigidly fixed therewith, either by way of welding, or some other type of fastener, and wherein the float is then usable by the finisher for smoothing out concrete poured in place. These floats normally are of integral construction, having no means for providing adjustment to its interconnecting handle, and therefore, must be used by the concrete finisher as is, and as obtained and acquired from the supply house.

This invention relates generally to a hand float, and more particularly one having an adjustable handle that can be manipulated at the desire of its user.

The principal object of this invention is to provide a hand float wherein its handle may be slid along its length and fixed into that position found most desirable and which complements the skills of its user.

Another object of this invention is to provide a hand float having guide means arranged integrally from its upper surface, and for accommodating an adjustable handle therewith.

Still another object of this invention is to provide a hand float, which may include a plate means of extra length, and having an adjustable handle connected therewith and which can be slid along the length of said plate in order to provide for its disposition at that position most convenient to its skilled user.

Still another object of this invention is to provide fastening that means interconnect within guide means upon a hand float to facilitate the rapid connection of its handle therewith.

These and other objects will become more apparent to those skilled in the art upon reviewing the summary of this invention, and upon undertaking a study of the description of its preferred embodiment, in view of the drawings.

SUMMARY OF THE INVENTION

In accordance with this invention, a hand float is formed having a plate means of usual or extra length, with the bottom of the plate means normally containing a smooth surface so as to function as both a means for smoothing out and finishing a poured concrete surface, and having sufficient straight edges so as to enhance its utility during the performance of such a finishing function. The plate means includes a pair of integral guides extending upwardly from its upper surface, normally extending coextensively along the length of the float, and which guides include inturned edges for accommodating fastener means for securing a handle to the said float. A pair of fastenings may comprise a nut and bolt combination, with perhaps the head of the bolt being configured in the shape of a "T," so as to allow their accommodation within the space intermediate the guide means for securement of the handle therewith, upon tightening of said fasteners. And, the float may be constructed to differing configurations, either of the squared end type, the half round, round ends, tapering top, or to those usual shapes generally desired by the finisher for his tools for use in providing a pleasing and smooth surface upon a freshly poured slab of concrete.

BRIEF DESCRIPTION OF THE DRAWINGS

In the drawings, FIG. 1 provides a plan view of a jumbo hand float;

FIG. 2 provides an end view of the hand float shown in FIG. 1;

FIG. 3 provides a side view of the hand flaot shown in FIG. 1;

FIG. 4 provides a plan view of a squared end hand float;

FIG. 5 provides a side view of the hand float shown in FIG. 4, and further disclosing its tapered top;

FIG. 6 provides an end view of the hand float shown in FIG. 4;

FIG. 7 shows a plan view of a rounded end hand float;

FIG. 8 provides a side view of the hand float shown in FIG. 7; and

FIG. 9 provides an end view of the hand float shown in FIG. 7.

DESCRIPTION OF THE PREFERRED EMBODIMENT

In referring to the drawings, and in particular FIGS. 1 through 3, there is shown what is identified as the jumbo hand float, incorporating a plate means 1 of substantial length, and having guide means 2 and 3 extending upwardly from the upward surface of the said plate means, all as more clearly shown in FIGS. 2 and 3. The upper edges of the guide means include integrally formed inturned edges, as at 4, and which are designed for embracing the nut or head 5 of a fastening means, as at 6, with one of said fastening means being provided at both ends of the handle 7. When the fastening means are tightly engaged in place, the handle becomes fixed to the plate means, by binding against the said upper lips of the guide means, thereby providing for its grasp by the concrete finisher in performing his task. On the other hand, should the finisher desire, as due to his own talents, that the handle means be located at some other position along the length of plate means, the fasteners 6 can be simply loosened, and the handle can be slid along the guide means 2 and 3, to its desired position, and then fastened once again in place for locking the handle securely with the said plate means.

This hand float, like all of the other hand floats to be described in this application, may be constructed, and more specifically its plate means, of a variety of metals, or even some polymer, but preferably the plate means, due to its integral construction in the formation of its guide means, its inturned lips, and the plate means itself, as can be more clearly seen in FIG. 2, may be fabricated as an extruded metal, such as aluminum, so that the entire assembly, with the exception of its handle and fastening means, can be fabricated as a single extrusion.

As can be seen in FIGS. 4 through 6, a slight modification to the configuration of the plate means is shown, although the principle of operation and attachment of the handle with said plate means is very similar to that previously described. As can be seen in FIG. 4, the plate means 8 incorporates a pair of guide means 9 and 10, having the integral inturned lips 11, and then with the fasteners 12 of the handle means 13 may secure the same rigidly in place. Or, in the alternative, the fasteners 12 may be loosened, and the handle 13 slid along the length of the shown guide means, for repositioning and refastening at an adjusted location. In this particular instance, the plate means is defined as a tapered top form of plate means, and as can be seen in FIG. 5, the guide means 9 and 10 are tapered, as at 14 and 15, at its forward and rear edges, to provide for ease of assembly of the handle into the guide means, for locking therewith during tightening of its fasteners 12. Another feature of this particular style of hand float is the preferably integral formation of sidewalk edges, as at 16 and 17, provided along the length of both side marginal edges of the plate means 8, and which are useful for aiding the finisher in moving slight accumulations of concrete for repositioning, in order to complete a concrete finishing operation. Once again, as can be seen, the entire plate means 8, with all of its various edges 16 and 17, and guide means 9 and 10, can be fabricated as one complete extrusion, as from aluminum, or other material, and then simply machined at those locations to eliminate its rough edges, as at the corner of the plate means, or for providing the tapers or bevels, such as at 14 and 15, at the ends of the guide means.

Another style of hand float is shown in FIGS. 7 through 9, having a slightly differing appearance, but operating upon the same principle as that described for the two previous floats. As can be seen, the plate 18 has the guide means 19 and 20 provided along its length, and having the integral inturned edges, as at 21, for cooperating with the fasteners 22 of the handle 23. The end edges of the plate means 18, in this particular instance, are rounded, as at 24, to provide attributes for the float that may aid the concrete finisher in completing a finishing operation.

Variations or modifications to the structure of these hand floats may occur to those skilled in the art upon reviewing the subject matter of this invention. Such variations or modifications, if within the spirit of this invention, or intended to be encompassed within the scope of any claims to patent protection issuing thereon. The description of the preferred embodiment set forth herein is done so for illustrative purposes only.

Having thus described the invention what is claimed and desired to be secured by Letters Patent is:

1. In an hand float for use in finishing concrete and the like and including a plate means useful for application upon concrete during its smoothing operations and for its finishing, and having a handle connected therewith, the improvement comprising said handle being releasably connected with the plate and slidably adjustable therewith to provide for its positioning at differing locations along its length for the convenience of its user, said plate having a pair of spaced apart guides securing upon its upper side, said guides having inturned edges provided along their upper edges, releasable fastening means provided upon the handle for securing the handle with the plate means after adjustment, one of each fastening means being located proximate each end of the handle, each fastening means including a combined nut and bolt, said combined nut and bolt at each end of the handle means provided for insertion and tightening into the plate means guides, each bolt of the fastening means including a T-shaped head for facilitating their accommodation within said guides, said guides provided upon the plate means having tapering ends, to provide for the ease of assembly of the handle into the guide means during insertion and adjustment.

2. The invention of claim 1 and including side means provided along the sides of the plate means and useful for moving accumulations of concrete during performance of a finishing operation.

* * * * *